United States Patent [19]

Koenig

[11] 3,971,458

[45] July 27, 1976

[54] COMBINATION IDENTIFICATION CARD HOLDER AND LUGGAGE LOCK

[75] Inventor: Stanley Koenig, Englishtown, N.J.

[73] Assignee: Atlantic Products Corporation, Trenton, N.J.

[22] Filed: Jan. 6, 1975

[21] Appl. No.: 538,745

[52] U.S. Cl. ..... 190/41 Z; 24/205.11 L; 70/68

[51] Int. Cl.[2] ..... A45C 3/00; A44G 19/36

[58] Field of Search ..... 24/205.11 L; 70/68; 190/41 Z

[56] References Cited

UNITED STATES PATENTS

| | | | |
|---|---|---|---|
| 1,557,382 | 10/1925 | Sundback | 190/41 Z |
| 1,980,714 | 11/1934 | Brady | 190/41 Z |
| 3,141,536 | 7/1964 | Fulton | 24/205.11 L |

FOREIGN PATENTS OR APPLICATIONS

| | | | |
|---|---|---|---|
| 594,648 | 6/1959 | Italy | 70/68 |
| 240,975 | 6/1946 | Switzerland | 70/68 |
| 606,982 | 8/1948 | United Kingdom | 70/68 |
| 894,401 | 4/1962 | United Kingdom | 24/205.11 L |

*Primary Examiner*—Bernard A. Gelak

[57] ABSTRACT

The disclosure relates to a combination identification tag and luggage lock for a double slide zipper closure for a luggage case or the like. One of the zipper slides is connected in an articulated manner to one end of an identification tag assembly. The identification tag, then can serve as a convenient means of gripping the zipper slide. The second zipper slide is connected in an articulated manner to a bayonet-type latch member, which is receivable in a socket or loop provided for the purpose on the identification tag assembly. When both of the zipper slides are secured to the identification tag, the luggage zipper is secured in a closed condition. Both of the zipper slide elements are connected to the identification tag assembly at one end, while the other end can remain detached from the luggage. The identification tag thus articulates easily in a rather conventional fashion, to facilitate observation of the identifying material.

At its normally free end, the identification tag assembly is provided with a snap fastener element, by means of which the tag may be immobilized in flush relation to the wall of the luggage case. The location of the snap fastener part on the luggage is such as to be convenient to the normal location of the zipper slides, when in the luggage closing position.

7 Claims, 3 Drawing Figures

COMBINATION IDENTIFICATION CARD HOLDER AND LUGGAGE LOCK

BACKGROUND OF THE INVENTION

The present invention relates to zippered closure arrangements for luggage. While the broadest aspects of the invention are somewhat wider in scope, the invention is most particularly applicable to double zipper closures. In addition, the invention is directed especially to zippered luggage closures in which a bayonet-type latching arrangement is provided, to enable the luggage to be locked in its closed condition.

A zippered luggage closure provided with a bayonet-type latching arrangement is reflected in the Fulton U.S. Pat. No. 3,141,536. In the construction of the Fulton patent, a single zipper slide element has articulated thereto a bayonet-type latching member. When the zipper slide is drawn to a luggage closing position, the latching element may be inserted in and engaged by a receiving socket. The zipper is thus retained in its closed position until manually released by depressing a spring biased locking element. The locking element may be immobilized with a key, if desired. The typical construction reflected in the Fulton patent provides for a single zipper slide closure. In many known luggage closure constructions, however, a pair of opposed zipper slides is provided, arranged to move in opposite directions. To open such a luggage closure, the zipper slides are moved apart, to the extremeties of their retracting movements. The zipper is closed by moving the zipper slides toward each other until they are substantially adjacent. In the closed condition, the two zipper slides may be at the midpoint of the zipper track, but this is not necessary. Typical such double zipper closure arrangements are reflected in the Gehrie U.S. Pat. No. 2,985,265 and the Pelavin et al U.S. Pat. No. 3,319,743.

SUMMARY OF THE INVENTION

The luggage closure of the present invention is particularly applicable to double zipper closures, such as reflected in the Gehrie and Pelavin et al patents mentioned above, and utilizes to advantage the bayonet-type locking arrangement in the above mentioned Fulton patent. In the closure construction of the invention, however, a novel and advantageous improvement is effected by combining in a unique and useful manner a zipper latching structure and a personal identification tag. The arrangement is such that, when the luggage is properly closed and latched, the identification tag, which forms part of the latching mechanism, is conveniently located and easily accessible for identification of the luggage.

In accordance with one of the specific features of the invention, an identification tag assembly is arranged and constructed to form the socket or receptor portion of the bayonet-type latch mechanism. Because of the size and typical configuration of the identification tag, the tag may be easily gripped for opening of the zipper slide to which the latch socket is attached. The other slide, carrying the bayonet element of the latch mechanism, is easily gripped by that bayonet element. The convenient size and handleability of the identification tag also enables the socket portion of the latch mechanism to be easily manipulated and positioned for insertion of the bayonet element, so that the mechanical manipulations of closing and latching the luggage are greatly expedited.

In accordance with another and more specific aspect of the invention, there is provided, in a luggage closure arrangement as generally described in the preceding paragraph, a novel and advantageous snap securing arrangement for releasably securing the identification tag in a physically convenient and visually prominent position on the luggage. At the same time, this serves effectively to fix the location of the closed zipper slides at a conveniently accessible location.

For a better understanding of the above and other features and advantages of the invention, reference should be made to the following description of a preferred embodiment, and to the accompanying drawing.

DESCRIPTION OF A PREFERRED EMBODIMENT

Figure 1:
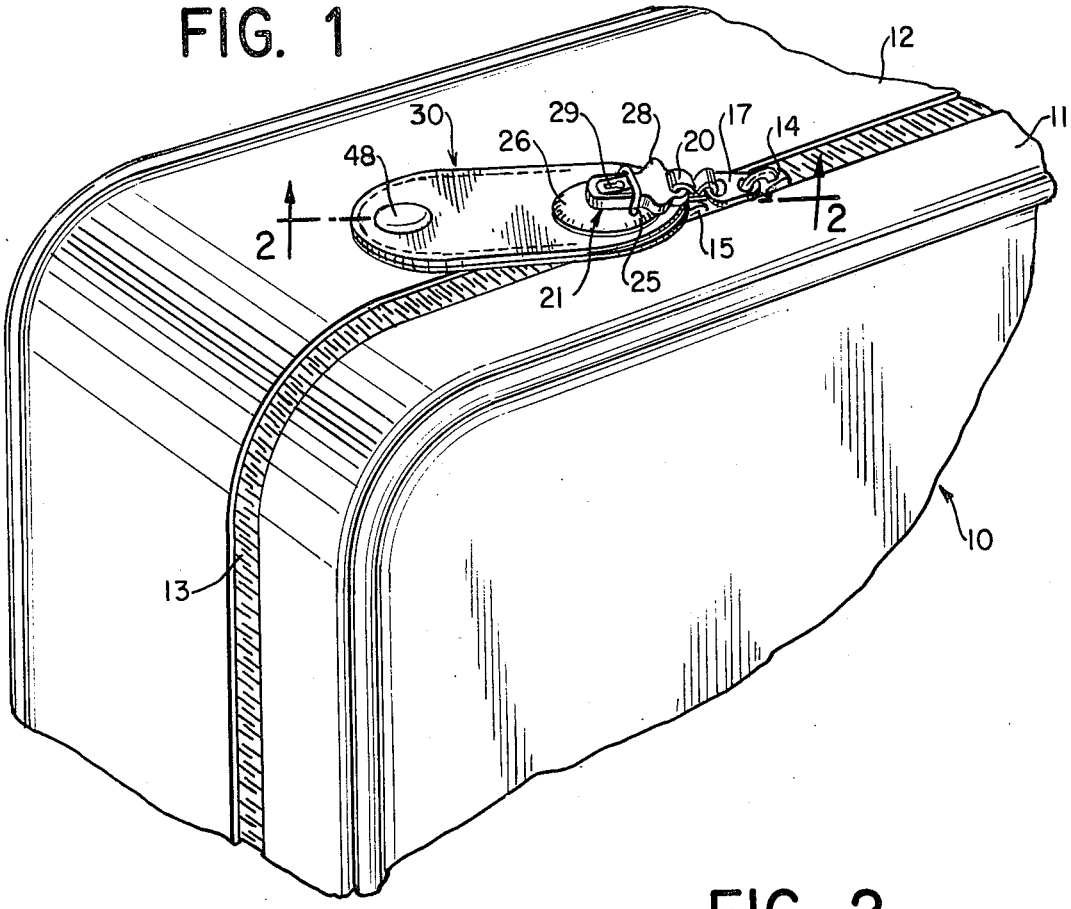
FIG. 1 is a fragmentary, perspective view of a conventional luggage article having a zipper closure constructed in accordance with the principles of the invention.

Referring now to the drawing, the reference numeral 10 designates in general a luggage article of a typical, conventional configuration. The upper and lower portions 11, 12 of the luggage case are conventionally hinged along one side (not shown) and are arranged to be closed and secured by a zipper 13 extending around three sides of the luggage case. Luggage articles of this general construction are well known and widely used.

Figure 2:
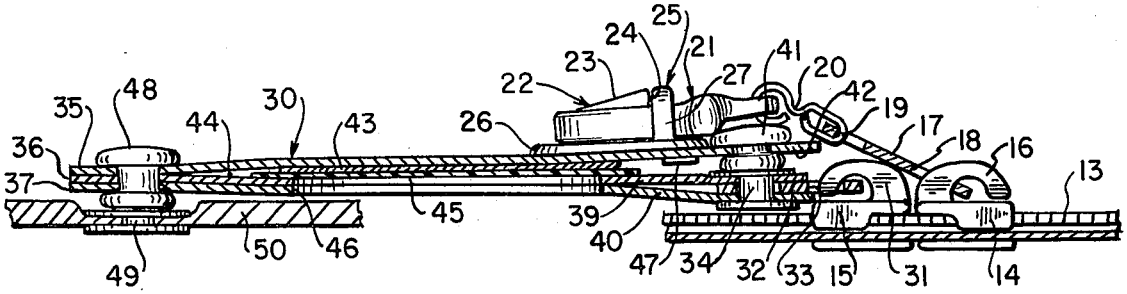
FIG. 2 is an enlarged, fragmentary, cross sectional view taken generally on line 2—2 of FIG. 1.

Commonly, the closure means for the zipper 13 comprises a pair of zipper slides 14, 15 arranged in opposed relation. The zipper 13 is closed by bringing together the two zipper slides, substantially as indicated in FIGS. 1 and 2. Opening of the luggage is effected by moving the slides to fully retracted positions, at the opposite end extremeties of the zipper track.

In accordance with the invention, a bayonet-type latching element is articulated to one of the zipper slides, in the illustrated instance the slide 14. In this respect, the zipper slide 14 is provided with an integral lug 16 which loosely engages a connecting plate 17 through an aperture 18 in one end. A second aperture 19 at the other end of the connecting plate 17 loosely engages a connector link 20. A bayonet-type luggage latch element 21 is loosely secured by the connector link 20, as reflected particularly in FIG. 2. The arrangement is such that the latching element 21 is loosely and freely swingable with respect to the zipper slide 14, while being permanently attached thereto. In accordance with conventional design, the latching element 21 is provided with a resiliently biased locking element 22, which is provided with a forwardly inclined upper surface 23 and a generally vertical abutment surface 24. The arrangement is such that the latching element 21 may be inserted in a receiving socket 25 formed by a flat metal plate 26 and locking bar 27 of inverted U-shaped configuration.

To secure the two members of the latch mechanism, the bayonet element 21 is inserted in the opening formed by the latch bar, and pushed forwardly until the upwardly biased locking element 22 clears the bar 25 and snaps upward. The bayonet element 21 is then secured between the shoulder surface 24 on the locking element and enlarged shoulders 28 provided on the bayonet element. The locking mechanism may be released by pressing downwardly on the lock element 22 in a well known manner. Typically, the locking element 22 may be immobilized in its raised position by means of an internal lock mechanism, in itself not significant to the invention, which can be controlled by a key inserted through a key opening 29 in the lock member.

In accordance with the present invention, the socket or receiving portion of the latch mechanism is secured to and forms a permanent part of an identification tag assembly generally designated by the numeral 30. Pursuant to the invention, the identification tag assembly is swingably secured at one end to the attachment lug 31 forming part of the second zipper slide 15. For this purpose, a flat connecting plate 32 is provided, which is formed with an opening 33 at one end to engage the lug 31. A rivet-like connector 34, to be described further, is received in a second opening in the connector plate 32 and serves to secure the plate to the identification tag assembly.

In accordance with another specific aspect of the invention, the socket member 25 of the latch assembly is secured to the identification tag 30 adjacent one end thereof, which is the same end to which the zipper slide 15 is secured. Thus, when the zipper slides 14, 15 are brought into substantially abutting adjacency, as reflected in FIG. 2, the socket portion 25 of the latch mechanism is located in close proximity to the zipper slide 14, enabling the bayonet element 21 to be easily inserted in the socket element.

In the illustrated form of the invention, the identification tag assembly 30 advantageously is of multiple layer construction, although it will be understood that the specifics of the structure of the identification tag itself are, in general, not critical to the invention. As reflected best in FIG. 2, the identification tag assembly 30 comprises three layers 35–37 of thin, flat material, typically of identical size and shape suitable to the intended functions of providing an identification medium and of being easily gripped by the hand. To advantage, the material of which the layers 35–37 are formed may be a flexible, plastic material, possibly but not necessarily simulating leather in appearance, and which has a reasonable tensile strength. The three layers of material are secured together, as by rows of stitching 38, in a manner providing for one end of the tag assembly to be open for the insertion of identification materials.

As reflected in FIG. 2, two of the layers 36 and 37 of the tag assembly are separated sufficiently at the open end of the assembly to receive the connecting link 32. The link is then secured to the tag assembly, and the otherwise unattached flaps 39, 40 are secured together, by means of the rivet 34. This provides a secure and attractive arrangement for attaching the identification tag assembly to the zipper slide 15, as will be understood.

Figure 3:
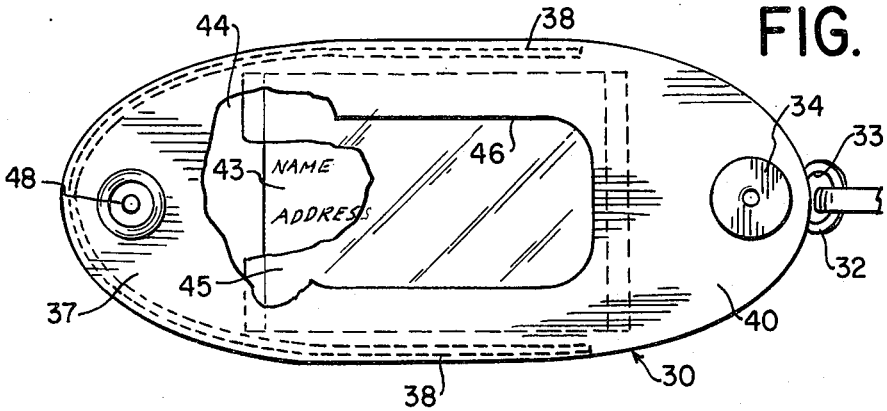
FIG. 3 is a bottom plan view of an identification tag assembly as incorporated in the structure of the invention.

To advantage, the rivet 34 also constitutes the male element of a snap fastener combination. The button or female element 41 is secured to the third free flap 42, at the end of the upper tag layer 35. When the snap fastener is closed, the upper flap 42 is secured to the remaining flaps 39, 40. By opening the snap fastener assembly 41, 34, access is provided to the pocket 44 formed between the upper and middle tag layers 35, 36. In a typical application, an identification card 43 (FIG. 3) is inserted into the pocket. A protective sheet 45, of clear, transparent material, may also be inserted into the pocket. In appropriate cases, the protective layer 45 may also be secured to the tag assembly by means of the stitching 38, as will be appreciated. In the construction shown, the tag layers 36, 37 are cut to provide a window opening 46, through which the identification card may be viewed.

As shown in FIG. 2, the plate 26, forming part of the latch socket 25, is secured to the upper tag layer 35, as by means of securing lugs 47. Thus, the socket assembly 25 forms, in effect, an integral part of the identification tag, freely and swingably attached to the zipper slide 15.

In accordance with one of the specific features of the invention, the identification tag 30 is provided with a secondary snap fastener means 48, constituting the female element of the snap fastener combination, which is arranged for cooperation with a male snap fastener element 49 secured to the casing wall 50 of the luggage article. To advantage, the snap fastener 48 is located at the free end of the identification tag assembly 30. The male portion 49 of the snap fastener is located adjacent to the zipper track and in a position such that the snap fastener elements 48, 49 may be engaged when the zipper slides are in a convenient closure position along the zipper track, as reflected in FIG. 1. Thus, with the zipper slides closed and latched, and in the desired location along the zipper track, the snap fasteners 48, 49 may be engaged. This serves to retain the zipper slides in the desired, convenient location, and also serves to secure the luggage tag in flush relation to the luggage case, where it is less likely to be accidentally damaged or torn away. Moreover, when the snap fasteners 48, 49 are engaged, the identification tag assembly is held stabilized in a flat orientation, such that the socket portion of the latch mechanism is conveniently positioned, providing immediate access to the locking element 22 for opening the luggage. Likewise, if desired, the tag assembly 30 may be secured by the snap fasteners 48, 49, prior to engagement of the latch parts 21, 25, in order to stabilize the position of the socket 25 and facilitate the insertion of the latch element 21.

In the embodiment shown, the window 46 of the identification tag assembly is oriented to face downward when the snap fasteners 48, 49 are engaged. This provides for a degree of privacy to the luggage owner, while permitting easy verification of ownership by disconnecting the fasteners 48, 49 as necessary. It will be readily understood, of course, that the identifying information may be oriented face upward, if desired.

The combining of the identification tag assembly with the zipper latch mechanism, in a manner above described, is both unique and advantageous. By combining the identification tag with the socket portion of the latch mechanism, the slider element carrying that portion of the mechanism is more conveniently handled and manipulated, in opening and closing operation. Moreover, the manipulations required for connecting the parts of the latch mechanism are considerably simplified. By securing the identification tag to a zipper slide, adjacent one end of the tag, and securing the latch socket member to that same end of the identification tag, the socket is positioned in convenient proximity to both of the zipper slides, when the slides brought into adjacency in closing the zipper track. Both the bayonet element and the socket element of the latch mechanism are freely and swingably secured to their respective zipper slides, permitting easy insertion of the bayonet element into the socket.

In providing for the identification tag assembly to be secured to the luggage case, as by means of the snap fastener elements 48, 49, a number of advantages accrue: The socket portion of the latch mechanism is held in a stable, accessible position and/or orientation, to simplify both the insertion and removal of the bayonet element 21, in latching and unlatching the zipper slides; the identification tag is protected during transit by being held tightly against the luggage wall; and privacy of the luggage owner is maintained, while at the same time the identifying information is readily available to those having occasion to refer to it.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. A combination luggage closure and identification tag assembly, which comprises a. a luggage article or the like having slide fastener type closure means, b. said slide fastener including a pair of opposed slide elements, c. an identification tag member swingably connected to one of said slide elements and serving as a pull tag therefor, d. a latch member swingably carried by the other of said slide elements and serving as a pull tag therefor, e. latch receiving means on said identification tag member for receiving and engaging with said latch member for lockingly securing said slide elements in adjacent relationship to retain said slide fastener in its closed position, and f. cooperating snap fastener means on said identification tag member and on said luggage article, g. said snap fastener means being engageable, when said latch member and latch receiving means are engaged, to releasably retain said identification tag member in a predetermined position on said luggage article.

2. The combination luggage closure and identification tag assembly of claim 1, further characterized by a. said identification tag member being swingably connected to said one slide element on one side of the tag and adjacent one end thereof, and b. said latch receiving means being secured to the other side of said identification tag member and adjacent said one end.

3. The combination luggage closure and identification tag assembly of claim 2, further characterized by a. said latch member comprising a bayonet-type member having a spring-urged, retractable locking element, and b. said identification tag member having secured thereto a loop forming section defining, together with one surface of said identification tag member, a restricted socket for receiving said latch member and engaging said locking element.

4. The combination luggage closure and identification tag assembly of claim 3, further characterized by a. cooperating snap fastener means on said one slide element and said identification tag member, and b. said cooperating snap fastener means being so related to said loop forming section that the latter is outwardly exposed when the snap fastener means are engaged, to facilitate access to said latch member.

5. The combination luggage closure and identification tag assembly of claim 4, further characterized by a. said latch member having a key-receiving opening, and b. said identification tag member, when said snap fastener means are secured together, holding said latch member relatively immobile, with said key-receiving opening outwardly exposed, to facilitate locking and unlocking.

6. A combination luggage closure and identification tag assembly, which comprises a. a luggage article or the like having a slide fastener type closure means including at least one movable slide element, b. an identification tag swingably connected to said slide element and readily grippable to facilitate opening and closing movements of said slide member, c. said slide fastener including a bayonet-type latch member and cooperable latch receiving means, d. one of said latch member or latch receiving means being movable with and forming a part of said identification tag, e. said slide fastener including a second movable slide element, f. the other of said latch member or latch receiving means being secured to and movable with said second slide member, and g. means independent of said slide fastener for releasably securing said identification tag to said luggage article when said slide elements are latched together in closed position.

7. A combination luggage closure and identification tag assembly according to claim 6, further characterized by a. said identification tag mounting a latch receiving member of generally inverted U-shaped configuration, and b. said latch member being swingably connected to said second slide member and being receivable in the opening formed between said identification tag and said latch receiving member.

* * * * *